US010120322B2

(12) United States Patent
Ohno et al.

(10) Patent No.: US 10,120,322 B2
(45) Date of Patent: Nov. 6, 2018

(54) IMAGE FORMING APPARATUS

(71) Applicant: CANON KABUSHIKI KAISHA, Tokyo (JP)

(72) Inventors: Masaru Ohno, Ebina (JP); Kenji Watanabe, Suntou-gun (JP); Takao Kume, Yokohama (JP); Marehiko Hirajima, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/628,373

(22) Filed: Jun. 20, 2017

(65) Prior Publication Data

US 2018/0004149 A1 Jan. 4, 2018

(30) Foreign Application Priority Data

Jul. 4, 2016 (JP) ..... 2016-132601

(51) Int. Cl.
*G03G 15/00* (2006.01)
*G03G 15/16* (2006.01)
(Continued)

(52) U.S. Cl.
CPC ..... *G03G 15/80* (2013.01); *G03G 15/2021* (2013.01); *G03G 15/2039* (2013.01); *G03G 15/2075* (2013.01); *G03G 15/2089* (2013.01); *G03G 15/6564* (2013.01); *G03G 21/203* (2013.01); *G03G 15/0283* (2013.01);
(Continued)

(58) Field of Classification Search
CPC ..... G03G 15/80; G03G 15/1675; G03G 15/2021; G03G 15/2039; G03G 15/2075; G03G 15/2078; G03G 15/0283; G03G 15/2089; G03G 15/5037; G03G 15/6564; G03G 15/657; G03G 21/08; G03G 21/20; G03G 21/203; G03G 21/206
See application file for complete search history.

(56) References Cited

U.S. PATENT DOCUMENTS

2006/0245768 A1* 11/2006 Takeda ..... G03G 15/55 399/16
2016/0139546 A1* 5/2016 Imaizumi et al. ..... G03G 15/2017 399/322

FOREIGN PATENT DOCUMENTS

JP 2013-130709 A 7/2013
JP 2013-174800 A 9/2013
(Continued)

*Primary Examiner* — Joseph S Wong
(74) *Attorney, Agent, or Firm* — Canon U.S.A., Inc. IP Division

(57) ABSTRACT

An image forming apparatus includes an image bearing member, a transfer member, a power source, a detection unit, and a fixing unit. The transfer member transfers a toner image to a transfer material from the image bearing member. The detection unit detects electric current flowing in the transfer member when the power source applies voltage to the transfer member. The fixing unit fixes a toner image to a transfer material by heat. The heat to the fixing unit is controlled where a subsequent transfer material conveyance stops after the transfer material is discharged from the fixing unit, in a case where a second current value, detected when voltage is applied to the transfer member contacting the fixing unit and the transfer member, is greater than a first current value detected when voltage is applied to the transfer member before the transfer material reaches the fixing unit.

31 Claims, 9 Drawing Sheets

(51) Int. Cl.

| | |
|---|---|
| ***G03G 15/20*** | (2006.01) |
| ***G03G 21/08*** | (2006.01) |
| ***G03G 21/20*** | (2006.01) |
| *G03G 15/02* | (2006.01) |

(52) U.S. Cl.
CPC ..... *G03G 15/1675* (2013.01); *G03G 15/2078* (2013.01); *G03G 15/5037* (2013.01); *G03G 15/657* (2013.01); *G03G 21/08* (2013.01); *G03G 21/20* (2013.01); *G03G 21/206* (2013.01)

(56) References Cited

FOREIGN PATENT DOCUMENTS

| | | | |
|---|---|---|---|
| JP | 2015-001599 | A | 1/2015 |
| JP | 2015-138109 | A | 7/2015 |

* cited by examiner

IMAGE FORMING APPARATUS

BACKGROUND OF THE INVENTION

Field of the Invention

The present disclosure relates to an image forming apparatus such as a copying machine or a printer employing an electrophotographic method.

Description of the Related Art

In an image forming apparatus employing an electrophotographic method, a toner image borne by an image bearing member is electrostatically transferred to a transfer material such as a sheet of paper or anoverhead projector (OHP) sheet by applying voltage to the transfer member arranged to face the image bearing member such as a drum-shape photosensitive member (hereinafter, referred to as "photosensitive drum") or an intermediate transfer member. Thereafter, the transfer material to which the toner image has been transferred is conveyed to a fixing unit, and the fixing unit applies heat and pressure to the transfer material to fix the toner image thereon.

An amount of moisture contained in a transfer material varies according to an environment where the image forming apparatus is used. For example, a transfer material absorbs moisture to have a relatively high moisture content in a high-humidity environment (hereinafter, referred to as "moist sheet"), and the transfer material is dried to have a relatively low moisture content in a low-humidity environment (hereinafter, referred to as "dried sheet").

In the technique discussed in Japanese Patent Application Laid-Open No. 2013-130709, in order to precisely acquire a moisture content of the transfer material, an electric current value flowing in an image bearing member from a transfer member is detected, and the moisture content of the transfer material is acquired from the detected current value. In Japanese Patent Application Laid-Open No. 2013-130709, an electric current value flowing in the image bearing member from the transfer member without interposing the transfer material and an electric current value flowing in the image bearing member from the transfer member via the transfer material are detected. Then, the misture content of the transfer material is acquired from a difference of electric resistances of the transfer material acquired from the respective electric current values.

However, according to the technique described in Japanese Patent Application Laid-Open No. 2013-130709, although the moisture content of the transfer material can be acquired, it is difficult to reduce image defect when water droplets are adhered to a fixing unit due to dew condensation. When a moist sheet is fed to the fixing unit, water vapor is generated from the moist sheet rapidly heated at high temperatures, so that water droplets may be adhered to the fixing unit due to dew condensation. If water droplets are adhered to the fixing unit when a toner image is transferred to the transfer material from the image bearing member, a part of the transfer current necessary to transfer the toner image to the transfer material flows in an apparatus main unit or the ground via the water droplets, so that there is a risk in which the transfer current becomes insufficient to cause image defect to occur.

SUMMARY OF THE INVENTION

The present disclosure is directed to an image forming apparatus capable of reducing occurrence of image defect by executing dehumidification control in a case where water droplets are adhered to a fixing unit due to dew condensation.

According to anaspect of the present invention, an image forming apparatus includes an image bearing member configured to bear a toner image, a transfer member abutting on the image bearing member and configured to transfer a toner image to a transfer material from the image bearing member, a power source configured to apply voltage to the transfer member, a detection unit configured to detect electric current flowing in the transfer member when voltage is applied to the transfer member from the power source, a fixing unit configured to fix a toner image to a transfer material by heating the transfer material to which a toner image has been transferred by a heating unit, and a control unit configured to control the heating unit to heat the fixing unit, wherein the control unit controls the heating unit to heat the fixing unit in a state where conveyance of a subsequent transfer material stops after the transfer material that is in contact with the fixing unit is discharged from the fixing unit, in a case where a second current value that is detected by the detection unit when voltage is applied to the transfer member from the power source in a state where a transfer material is in contact with the fixing unit and the transfer member is greater than a first current value that is detected by the detection unit when voltage is applied to the transfer member from the power source before the transfer material reaches the fixing unit by a predetermined value or more.

Further features of the present invention will become apparent from the following description of embodiments with reference to the attached drawings.

DESCRIPTION OF THE EMBODIMENTS

Hereinafter, embodiments will be described in detail with reference to the appended drawings. Sizes, materials, shapes and relative arrangements of constituent members described in the below-described embodiments should be changed as appropriate according to a configuration and various conditions of an apparatus to which the present disclosure is applied. Accordingly, the below-described embodiments are not intended to limit the scope unless such limitations are explicitly mentioned hereinafter.

Figure 1:
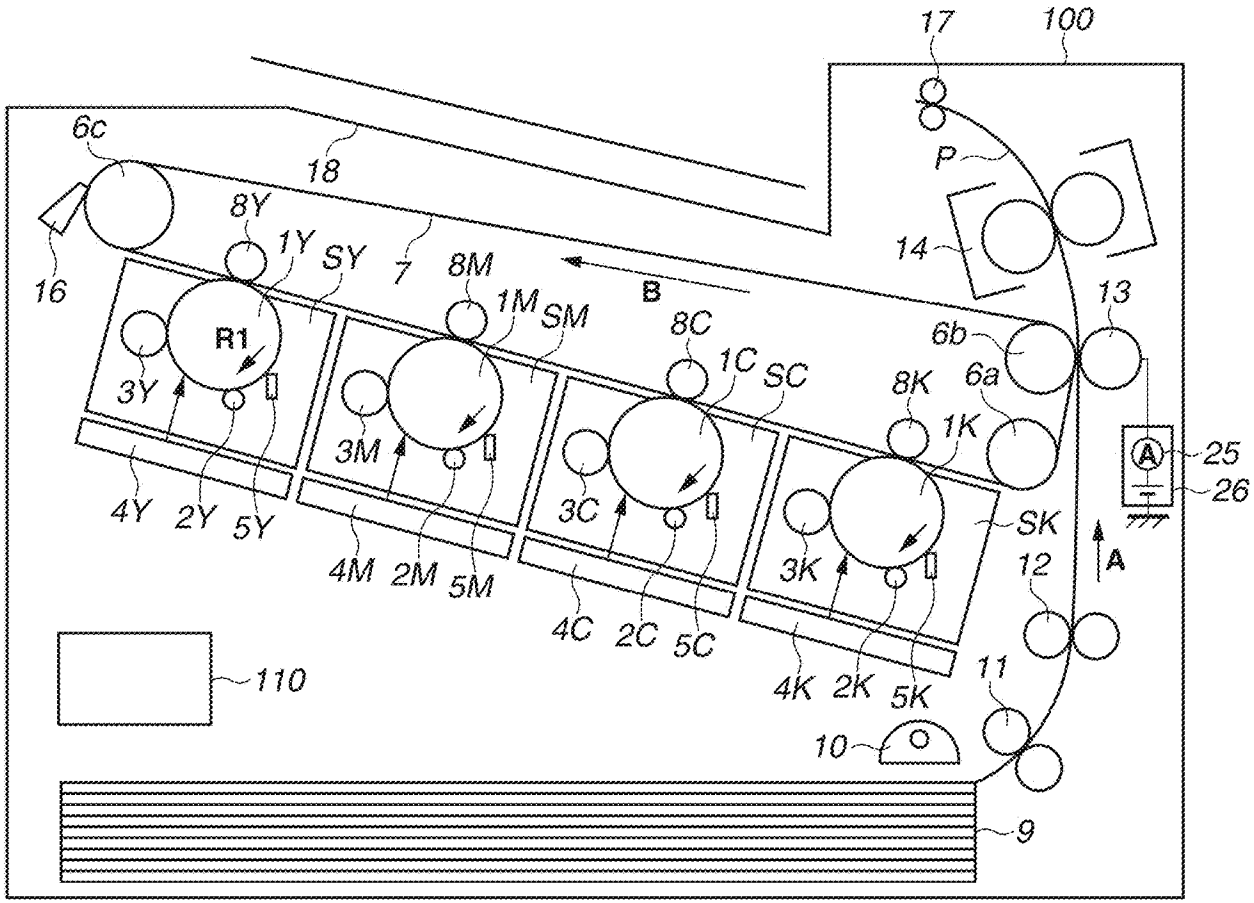
FIG. 1 is a schematic cross-sectional diagram illustrating an image forming apparatus according to a first embodiment.

FIG. 1 is a schematic cross-sectional diagram illustrating a configuration of an image forming apparatus 100 according to a present embodiment. As illustrated in FIG. 1, the image forming apparatus 100 according to the present embodiment is a color image forming apparatus in which image forming units SY, SM, SC, and SK for forming images of respective colors of yellow (Y), magenta (M), cyan (C), and black (K) are arranged at certain intervals. In the present embodiment, configurations and operations of the image forming units SY, SM, SC, and SK are substantially the same except for the colors of images formed thereby. Accordingly, indexes Y, M, C, and K added to the symbols which represent respective colors will be omitted when configurations and operations of the image forming units are not specifically distinguished from each other. Further, in the below described embodiment, a lengthwise direction is a direction orthogonal to a conveyance direction of a transfer material P (indicated by an arrow A in FIG. 1) with respect to an image forming face of the transfer material P.

<Image Forming Operation>

The image forming operation executed by the image forming apparatus 100 of the present embodiment will be described with reference to FIG. 1. An image signal transmitted from an information processing apparatus such as a personal computer (not illustrated) is internally received and analyzed by the image forming apparatus 100 to be transmitted to a control unit 110. Then, the control unit 110 controls respective units according to the information analyzed from the image signal, so that image forming operation starts in the image forming apparatus 100.

The image forming unit S includes a photosensitive drum 1 as a drum-shape photosensitive member, a charging roller 2 as a charging unit, a development roller 3 as a development unit, and a cleaning blade 5 as a cleaning unit.

The photosensitive drum 1 is rotationally driven a direction indicated by an arrow R1 in FIG. 1 at a predetermined circumferential speed, and uniformly charged with a predetermined polarity (in the present embodiment, a negative polarity) and a predetermined potential by the charging roller 2 in the course of rotation. Thereafter, the photosensitive drum 1 is exposed to light emitted from an exposure unit 4 according to the image signal, so that an electrostatic latent image is formed on a surface of the photosensitive drum 1. The electrostatic latent image formed on the surface of the photosensitive drum 1 is developed with toner supplied from the development roller 3, so that a toner image is formed on the photosensitive drum 1. Herein, the toner supplied from the development roller 3 is charged in a negative polarity. Thus, in the present embodiment, the electrostatic latent image is reversely developed with the toner charged in a polarity the same as a charging polarity of the photosensitive drum 1 charged by the charging roller 2. However, to present invention is not limited to the above, and embodiments are applicable to an image forming apparatus that positively develops an electrostatic latent image with toner charged in a polarity opposite to the charging polarity of the photosensitive drum 1.

An endless intermediate transfer belt 7 as an image bearing member stretched by tension rollers 6*a*, 6*b*, and 6*c* serving as stretching members is arranged to face the photosensitive drums 1Y, 1M, 1C, and 1K of respective colors. The intermediate transfer belt 7 is rotationally driven in a direction indicated by an arrow B in FIG. 1. Primary transfer rollers 8 that presses the intermediate transfer belt 7 against the photosensitive drums 1 are arranged on a side of an inner circumferential face of the intermediate transfer belt 7, and primary transfer portions are formed at the positions where the intermediate transfer belt 7 pressed by the primary transfer rollers 8 abuts on the photosensitive drums 1. While the toner images formed on the respective photosensitive drums 1Y, 1M, 1C, and 1K are passing through primary transfer portions, the toner images are sequentially overlapped and primarily transferred onto the intermediate transfer belt 7 from the photosensitive drums 1. Through the above operation, a toner image in a plurality of colors corresponding to a target color image is formed on the intermediate transfer belt 7.

A secondary transfer roller 13 as a transfer member is arranged to face the tension roller 6*b* via the intermediate transfer belt 7 as an image bearing member. The intermediate transfer belt 7 is pressed by the tension roller 6*b* to abut on the secondary transfer roller 13, so that a secondary transfer portion is formed on a position where the intermediate transfer belt 7 abuts on the secondary transfer roller 13. In the present embodiment, a roller member having an outer diameter of 18 mm, which is configured of a nickel-plated steel rod having an outer diameter of 8 mm covered with a formed body that mainly consists of a nitrile rubber (NER) material and an epichlorohydrin rubber material adjusted to have a volume resistance of $10^8$ Ω/cm and a thickness of 5 mm, is used as the secondary transfer roller 13. Further, the secondary transfer roller 13 is connected to a transfer power source 26 having a detection circuit 25 as a detection unit, and a toner image in a plurality of colors is secondarily transferred to a transfer material P from the intermediate transfer belt 7 when voltage is applied to the secondary transfer roller 13 from the transfer power source 26.

The transfer materials P stacked on a sheet feeding cassette 9 are fed by a sheet feeding roller 10, individually separated by a separation roller pair 11, and conveyed by a conveyance roller pair 12 in a direction indicated by the arrow A in FIG. 1. The transfer material P is conveyed to the secondary transfer portion at a predetermined conveyance speed (in the present embodiment, 100 mm/sec.) at a timing at which the toner image in the plurality of colors formed on the intermediate transfer belt 7 reaches the secondary transfer portion.

The transfer material P to which the toner image in the plurality of colors is transferred at the secondary transfer portion is conveyed to a fixing unit 14 so as to be heated and pressurized by the fixing unit 14, so that the toner of respective colors is fused and intermingled with each other and fixed to the transfer material P. The toner that has left on the intermediate transfer belt 7 after the secondary transfer is cleaned and removed by a cleaning blade 16 provided on a downstream side of the secondary transfer portion in a moving direction of the intermediate transfer belt 7.

In the image forming apparatus 100 of the present embodiment, a full-color image is formed on the transfer material P through the above-described operation, and the transfer material P on which image formation has been performed is discharged to a discharge tray 18 by a discharge roller pair 17.

<Fixing Unit>

Figure 2:
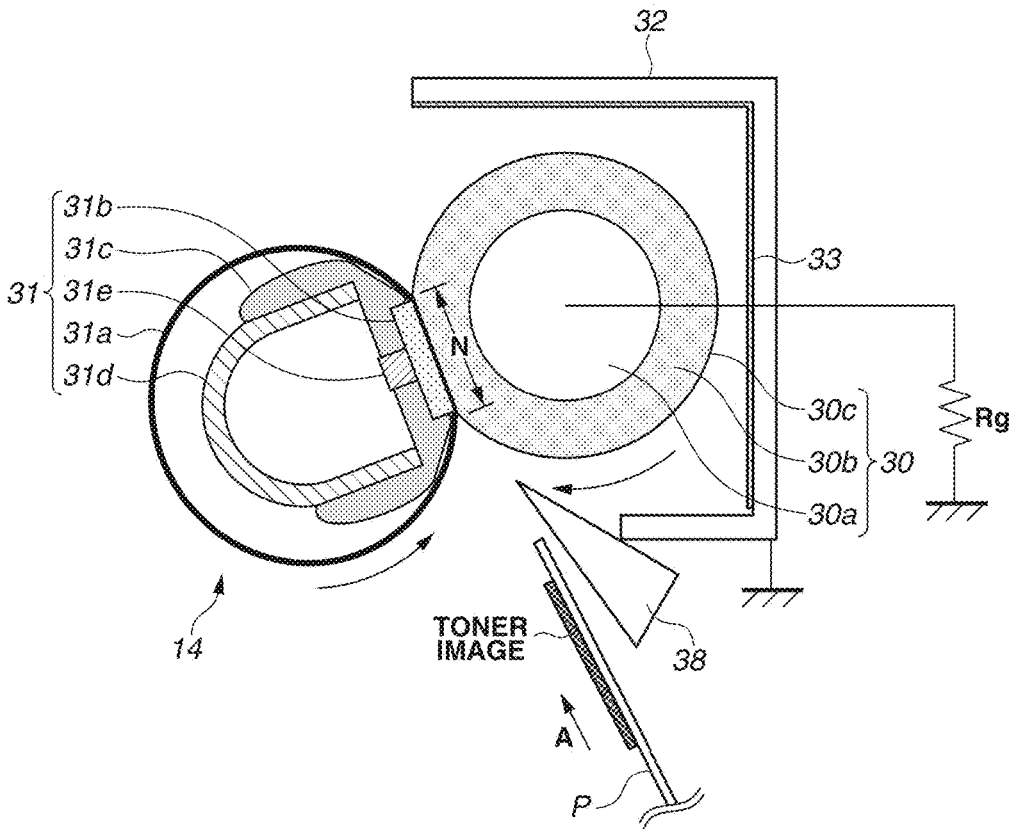
FIG. 2 is a schematic cross-sectional diagram illustrating a configuration of a fixing unit according to the first embodiment.

In the present embodiment, a film fixation type fixing, unit is employed. However, the fixing unit is not limited to the above, and embodiments are applicable to a configuration employing a fixing unit of another type such as a heat roller type. FIG. 2 is a schematic cross-sectional diagram illustrating a configuration of the fixing unit 14 of the present embodiment, and the fixing unit 14 will be described in detail with reference to FIG. 2.

As illustrated in FIG. 2, the fixing unit 14 includes a pressure roller 30 as a pressurizing unit, a heating unit 31, a fixing frame 32, and an insulating member 33.

The fixing frame 32 is a conductive housing that covers the pressure roller 30 and the heating unit 31. The fixing frame 32 is electrically connected to the ground so as to be prevented from being charged electrically, and the insulating member 33 is arranged between the fixing frame 32 and the pressure roller 30.

The pressure roller 30 is a conductive roller having a core metal 30*a*, anelastic layer 30*b* formed on the outer circumferential surface of the core metal 30*a*, and a release layer 30*c* formed an the outer circumferential surface of the elastic layer 30*b*. A silicon rubber material or a fluorine-containing rubber material can be used as the elastic layer 30*b*, and a fluorine-containing resin material such as tetrafluoroethylene-perfluoro (alkoxy vinyl ether)-copolymer (PFA) can be used as the release layer 30*c*. In the present embodiment, the silicon rubber elastic layer 30*b* having a thickness of approximately 3.5 mm and a width of approximately 226 mm in the lengthwise direction is formed by executing injection molding on the stainless steel core metal 30*a* having the outer diameter of 11 mm. Further, the release layer 30*c* is formed on an outer circumferential surface of the elastic layer 30*b* by covering the elastic layer 30*c* with a PFA resin tube having a thickness of approximately 40 μm. In addition, conductive carbon filler is added to the elastic layer 30*b* and the release layer 30*c*, so that the pressure roller 30 has an electrical resistance of approximately 10 kΩ.

The pressure roller 30 is rotatably supported at both ends in the lengthwise direction of the core metal 30*a* and grounded via a grounding resistor Rg having a grounding resistance of 1 GΩ. The pressure roller 30 has an outer diameter of 18 mm, and a hardness thereof measured by the Asker-C hardness meter is 54° at a weight of 9.8 N. In order to ensure a fixing portion N and durability of the pressure roller 30 or the heating unit 31, the pressure roller 30 may have a hardness within a range of 40° to 70° when the hardness is measured at a weight of 9.8 N by using the Asker-C hardness meter.

The heating unit 31 includes a film 31*a*, a plate-like heater 31*b*, a supporting portion 31*c* for supporting the heater 31*b*, and a pressure stay 31*d* for reinforcing the supporting portion 31*c*. In addition, the heater 31*b* is in contact with an inner circumferential surface of the film 31*a* at a position facing the pressure roller 30 via the film 31*a*.

The film 31*a* is a tubular flexible member having a base layer (not illustrated), an elastic layer (not illustrated) formed on the outer circumferential surface of the base layer, and a release layer (not illustrated) formed on the outer circumferential surface of the elastic layer. In the present embodiment, the film 31*a* has an inner diameter of 18 mm, a polyimide material having a thickness of approximately 60 μm is used as the base layer, a silicone rubber material having a thickness of approximately 150 μm is used as the elastic layer, and a PFA resin tube having a thickness of approximately 15 μm is used as the release layer.

The heater 31*b* is configured of a substrate made of ceramics such as alumina, a heat generating resistor made of silver-palladium alloy formed on the substrate through screen printing, and an electric contact point made of silver connected to the heat generating resister. In the present embodiment, the substrate of the heater 31*b* consists of a rectangular parallelepiped-shape alumina material having a length of 5.8 mm in the conveyance direction of the transfer material P and a thickness of 1.0 mm. The heat generating resistor is protected by a protection layer such as a glass coating. In order to increase the sliding performance of the heat generating resistor and the film 31*a*, heat-resisting grease is applied to a portion between the heat generating resistor and the inner circumferential surface of the film 31*a*. A thermistor 31*e* is attached to one surface of the heater 31*b* on the opposite side of another surface brought into contact with the film 31*a*.

The supporting portion 31*c* is formed of liquid crystalline polymer, so as to have rigidity, heat-resisting property, and heat-insulating property. The supporting portion 31*c* has a function of supporting the inner circumferential surface of the film 31*a* that is in contact with the supporting portion 31*c* and a function of supporting the heater 31*b*.

In order to increase the bending rigidity of the heating unit 31, the pressure stay 31*d* is formed of a bent stainless steel having a plate thickness of 1.6 mm, having a U-shape cross-sectional face when viewed in the lengthwise direction. The heater 31*b* supported by the pressure stay 31*d* and the supporting portion 31*c* is pressed against and brought into contact with the pressure roller 30 via the film 31*a*, so as to form a fixing portion N having a width of approximately 6.2 mm in the conveyance direction of the transfer material P. In the present embodiment, the film 31*a* and the pressure roller 30 have a press-contact force of 180 N in total.

When a toner image is fixed to the transfer material P by the fixing unit 14, rotational force from a driving source (not illustrated) is transmitted to the pressure roller 30, so that the pressure roller 30 is rotationally driven in a clockwise direction at a predetermined speed as illustrated in FIG. 2. With this configuration, the film 31*a* follows the rotational movement of the pressure roller 30 brought into contact with the outer circumferential surface thereof, so as to rotate in a counter clockwise direction while sliding on the heater 31*b* on the inner circumferential surface side.

In a state where a temperature detected by the thermistor 31*e* of the heater 31*b* reaches a target temperature after the film 31*a* and the pressure roller 30 rotate and the power is supplied to the heater 31*b*, the transfer material P is guided by a conveyance guide 38 and introduced to the fixing portion N. While the transfer material P is passing through the fixing portion N, the toner image secondarily transferred to the transfer material P at the secondary transfer portion is heated and pressurized, so that the toner image is fused and fixed to the transfer material P. The transfer material P that has passed the fixing portion N is separated from the film 31*a* due to a curvature of the film 31*a* and discharged to the discharge tray 18 by the discharge roller pair 17.

In the present embodiment, a distance between the secondary transfer portion and the fixing portion N of the image forming apparatus 100 is 50 mm. Accordingly, when an image is formed on a transfer material P having a normal A4 size or a letter-size, at the same time the toner image is fixed to the transfer material P at the fixing, unit 14, the toner image is secondarily transferred to the transfer material P from the intermediate transfer belt 7 at the secondary transfer portion.

<Occurrence of Image Defect Caused by Adhesion of Water Droplets to Fixing Unit>

Figure 3A:
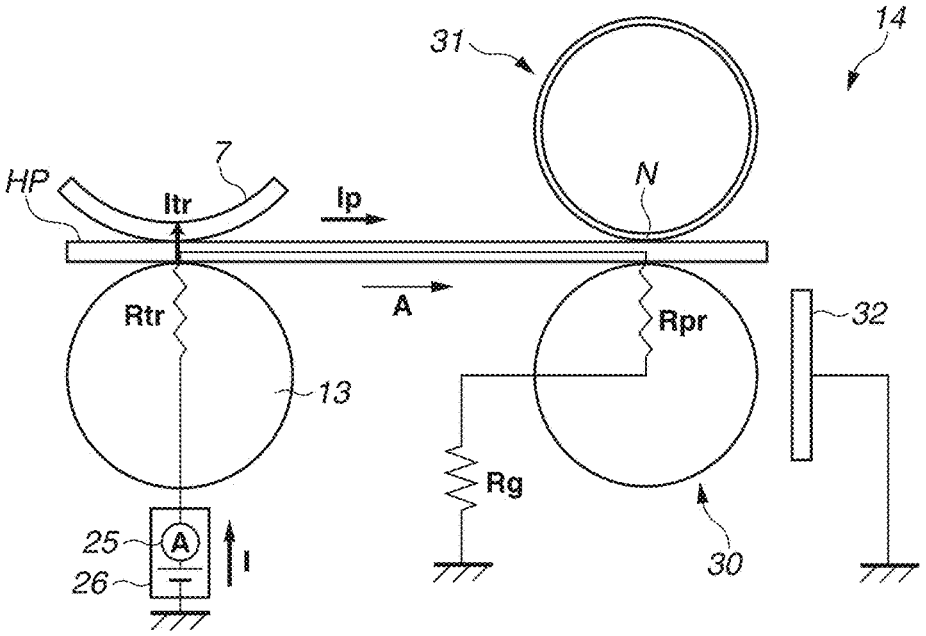
FIGS. 3A and 3B are schematic diagrams each illustrating an enlarged portion of a secondary transfer portion and the fixing unit according to the first embodiment.

The image defect occurring when water droplets are adhered to the fixing unit 14 due to dew condensation will be described in detail with reference to FIGS. 3A and 3B. FIG. 3A is a schematic diagram illustrating an enlarged portion from the secondary transfer portion to the fixing unit 14 in the present embodiment, and FIG. 3B is a schematic diagram illustrating an enlarged portion from the secondary transfer portion to the fixing unit 14 when water droplets are adhered to the fixing frame 32 in the present embodiment.

When the voltage is applied to the secondary transfer roller 13 from the transfer power source 26, a predetermined electric current I flows in the secondary transfer roller 13, and a predetermined transfer current Itr flows in the intermediate transfer belt 7 from the secondary transfer roller 13 at the secondary transfer portion. However, in a case where the transfer material P contains a large amount of moisture (hereinafter, referred to as "moist sheet HP"), as illustrated in FIG. 3A, in addition to the transfer current Itr flowing toward the intermediate transfer belt 7 from the secondary transfer roller 13, an electric current Ip passes through the moist sheet HP and flows toward the fixing portion N.

The transfer material P is likely to become a moist sheet HP if the transfer material P is kept in an environment having high temperature and high humidity, so that the electric current Ip flows to the ground via the pressure roller 30 when the moist sheet HP having low electrical resistance reaches the fixing unit 14 to be in contact with the conductive pressure roller 30. If a value of the electric current Ip is too large, image defect may occur because the transfer current Itr necessary for secondarily transferring the toner image to the transfer material P at the secondary transfer portion becomes insufficient. Accordingly, in the present embodiment, by grounding the conductive pressure roller 30 via the grounding resistor Rg having a relatively large grounding resistance value, image defect caused by the electric current Ip is suppressed. In FIG. 3A, a resistor Rtr is an electric resistor of the secondary transfer roller 13, and a resistor Rpr is an electric resistor of the pressure roller 30.

Figure 3B:
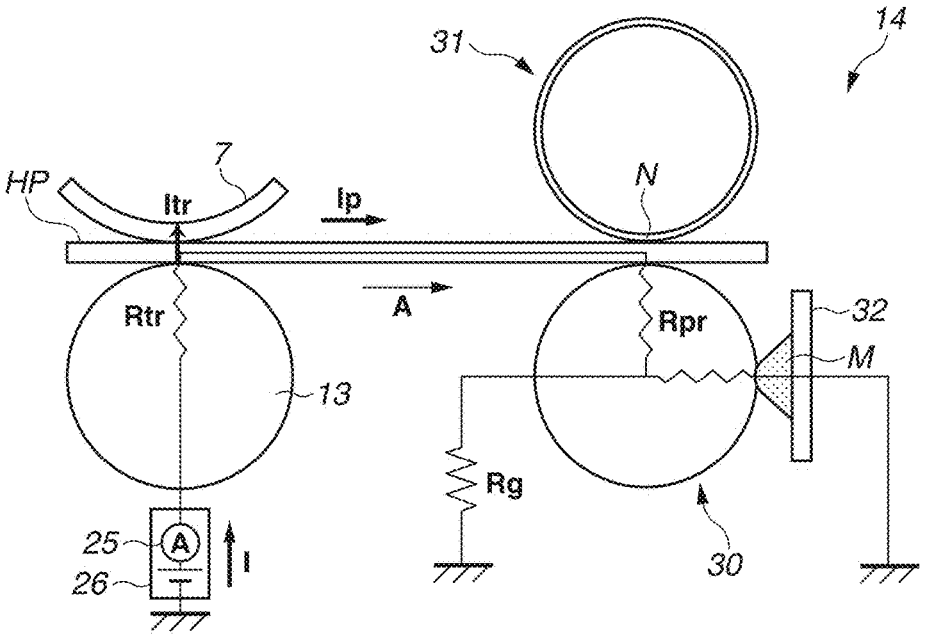

However, in a case where the moist sheets HP are fed to the fixing unit 14 consecutively, as illustrated in FIG. 3B, water vapor is generated from the moist sheets HP rapidly heated at a high temperature, so that a large amount of water vapor is condensed to form dew, and as a result, water droplets M are adhered to the fixing frame 32. Then, when the water droplets M are in contact with a surface of the pressure roller 30, the conductive pressure roller 30 and the fixing frame 32 are electrically brought into contact via the water droplets M. In order to prevent the fixing frame 32 from being charged electrically, the fixing frame 32 is electrically connected to the ground without interposing an electric resistor. In such a state, the electric current Ip flows to the ground via the conductive pressure roller 30, the water droplets M, and the fixing frame 32. As a result, if the image forming operation is continuously executed in a state where the water droplets M exist, the transfer current Itr necessary for transferring the toner image to the transfer material P from the intermediate transfer belt 7 at the secondary transfer portion becomes insufficient, so as to cause image defect to occur.

In the present embodiment, the control unit 110 determines that water droplets are adhered to the fixing unit 14 when the water droplets M adhered to the fixing frame 32 are in contact with the surface of the pressure roller 30 to cause the electric current Ip to flow to the ground via the water droplets M. Unless the pressure roller 30 and the fixing flame 32 are conducted via the water droplets M to cause the electric current Ip to flow to the ground, the control unit 110 determines that the water droplets are not adhered to the fixing unit 14 even if the water droplets M are adhered to the fixing frame 32.

<Detection of Water Droplets Adhered to Fixing Unit>

Hereinafter, with reference to FIGS. 4 and 5, a method of reducing the image defect by determining the presence or absence of water droplets adhered to the fixing unit 14 due to dew condensation in the present embodiment will be described.

Figure 4:
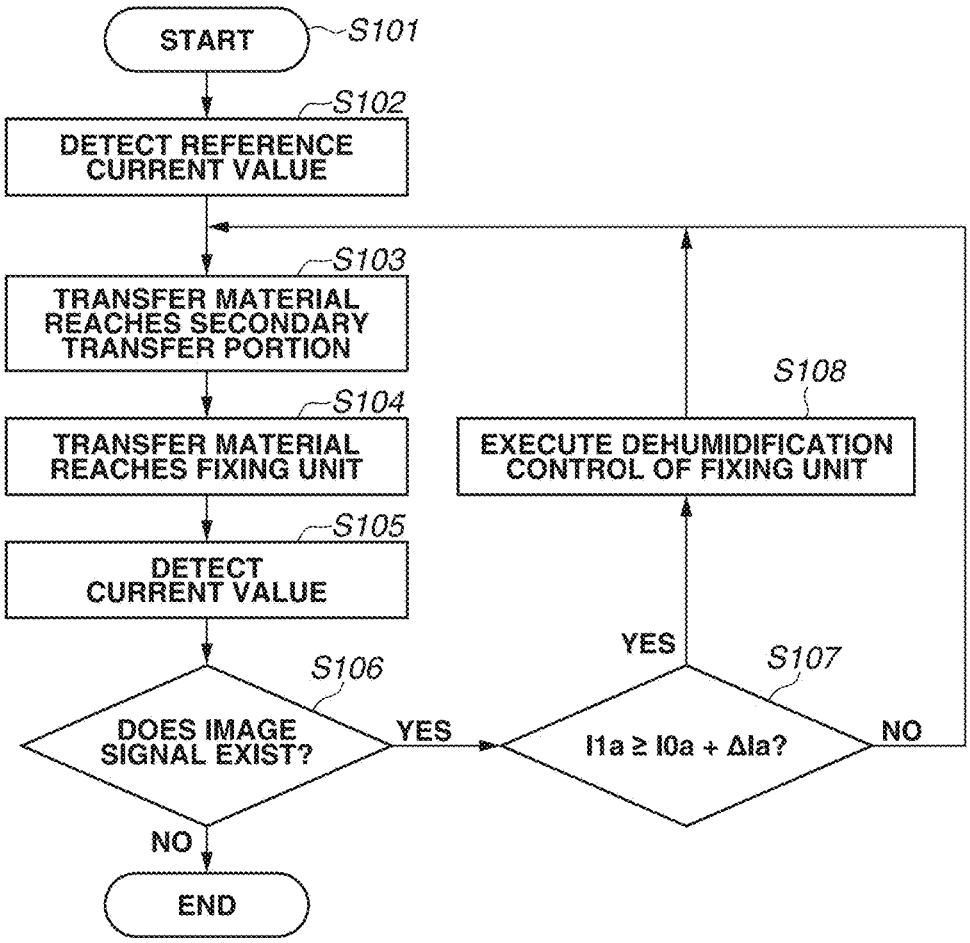
FIG. 4 is a flowchart illustrating dehumidification control according to the first embodiment.

FIG. 4 is a flowchart illustrating dehumidification control of the present embodiment. As illustrated in FIG. 4, first, in step S101, the image forming operation starts by the image forming apparatus 100. Then, in step S102, before the transfer material P reaches the secondary transfer portion, a predetermined voltage V0 is applied to the secondary transfer roller 13 from the transfer power source 26, and a reference current value I0*a* (i.e., a first current value) flowing in the secondary transfer roller 13 is detected by the detection circuit 25. Herein, a value of the voltage V0 is 700 V while a period for applying the voltage V0 is 1 sec., and a reference current value I0*a* is an average value of current values detected in that period.

In step S103, the transfer material P reaches the secondary transfer portion, and in step S104, the transfer material P reaches the fixing portion N of the fixing unit 14. Then, when the transfer material P is concurrently passing through the secondary transfer portion and the fixing unit 14 after reaching the fixing portion N, in step S105, the current value I1*a* (i.e., a second current value) flowing in the detection circuit 25 is detected. A secondary transfer operation is executed until the processing in steps S103 to S105 is completed, so that the predetermined voltage V0 is continuously applied to the secondary transfer roller 13 from the transfer power source 26 through constant voltage control.

In the present embodiment, a distance between the secondary transfer portion and the fixing portion N is 50 mm, a conveyance speed of the transfer material P is 100 mm/sec., and the detection circuit 25 detects 100 electric values per one second. For example, if a length of the transfer material P is 280 mm, a time period in which the transfer material P concurrently passes the secondary transfer portion and the fixing unit 14 in step S105 is 2.3 sec., so that 230 current values I1*a* are recorded.

In step S106, as to whether the image forming operation should be continuously executed is determined based on the image signal transmitted to the control unit 110. In a case where the image signal for forming an image on the subsequent transfer material P does not exist (NO in step S106), the image forming operation ends. In a case where the image signal for forming animage on the subsequent transfer material P exists (YES in step S106), the processing proceeds to step S107. In step S107, the current value I1*a* and the reference current value I0*a* are compared to each other. In a case where the current value I1*a* is greater than the reference current value I0*a* by a preset predetermined value ΔIa or more, there is a high possibility that the water droplets adhered to the fixing unit 14 causes the current Ip to flow to the ground, and thus image defect can be reduced by the control unit 110 executing the dehumidification control.

Herein, a value of the predetermined value ΔIa is determined according to the amount of electric current Ip flowing in the fixing unit 14, and the value thereof depends on the configuration of the image forming apparatus 100 such as a distance between the secondary transfer portion and the fixing portion N. By appropriately setting the value of the predetermined value ΔIa, precision of determination with respect to presence or absence of water droplets caused by dew condensation adhered to the fixing unit 14 can be increased. In the present embodiment, the value ΔIa is set as 30 μA.

As described above, when the current value I1*a* is greater than the reference current value I0*a* by the preset predetermined value ΔIa or more, the control unit 110 can determine that water droplets are adhered to the fixing unit 14. However, if a state where the current value I1*a* is greater than the reference current value I0*a* by the preset predetermined value ΔIa or more is continued for a predetermined time ΔTa, as to whether the water droplets adhered to the fixing unit 14 cause the electric current Ip to flow to the ground can be determined more precisely. This is because even in a state where the water droplets are not adhered to the fixing unit 14, electric current for the electrostatic capacitance of the fixing unit 14 may flow in the fixing unit 14 when the transfer material P reaches the fixing, unit 14.

Accordingly, by setting the predetermined time ΔTa, it is possible to suppress erroneous detection caused by the electric current temporarily flowing in the fixing unit 14 and to perform detection of water droplets caused by dew condensation more precisely. In the present embodiment, the predetermined time ΔTa is set as 0.3 sec. In other words, if a state where the current value I1*a* is greater than the reference current value I0*a* by the preset predetermined value ΔIa or more is continued for the predetermined time ΔTa (YES in step S107), the control unit 110 determines that water droplets are adhered to the fixing unit 14 due to dew condensation, and executes processing in step S108. In a case where the current value I1*a* is not in the above-described state (NO in step S107), the processing returns to step S103.

In step S108, as the dehumidification control executed by the control unit 110, the heating unit 31 of the fixing unit 14 and the pressure roller 30 are rotated while the heating unit 31 is being heated. Through the above operation, water droplets can be evaporated by increasing the temperature of the fixing unit 14. In the present embodiment, when adhesion of water droplets to the fixing unit 14 caused by dew condensation is determined, the control unit 110 executes the dehumidification control of the fixing unit 14 for 30 seconds in a state where the conveyance of the subsequent transfer material P stops after the transfer material P that is in contact with the fixing unit 14 is discharged from the fixing unit 14. When the dehumidification control is completed, the image forming apparatus 100 notifies a user that image forming operation can restart. Then, after the user has confirmed the notification, the processing returns to step S103, so that the control unit 110 restarts the image forming operation.

For example, providing a notification screen and a confirmation button on the image forming apparatus 100 may be considered as a specific method which allows the image forming apparatus 100 and the user to mutually provide or receive the notification and the confirmation. Further, in the present embodiment, although a control method of restarting the image forming operation after making the user confirm the notification has been described, the control method is not limited thereto, and the image forming operation may automatically start after the dehumidification control is completed by the control unit 110.

Figure 5:
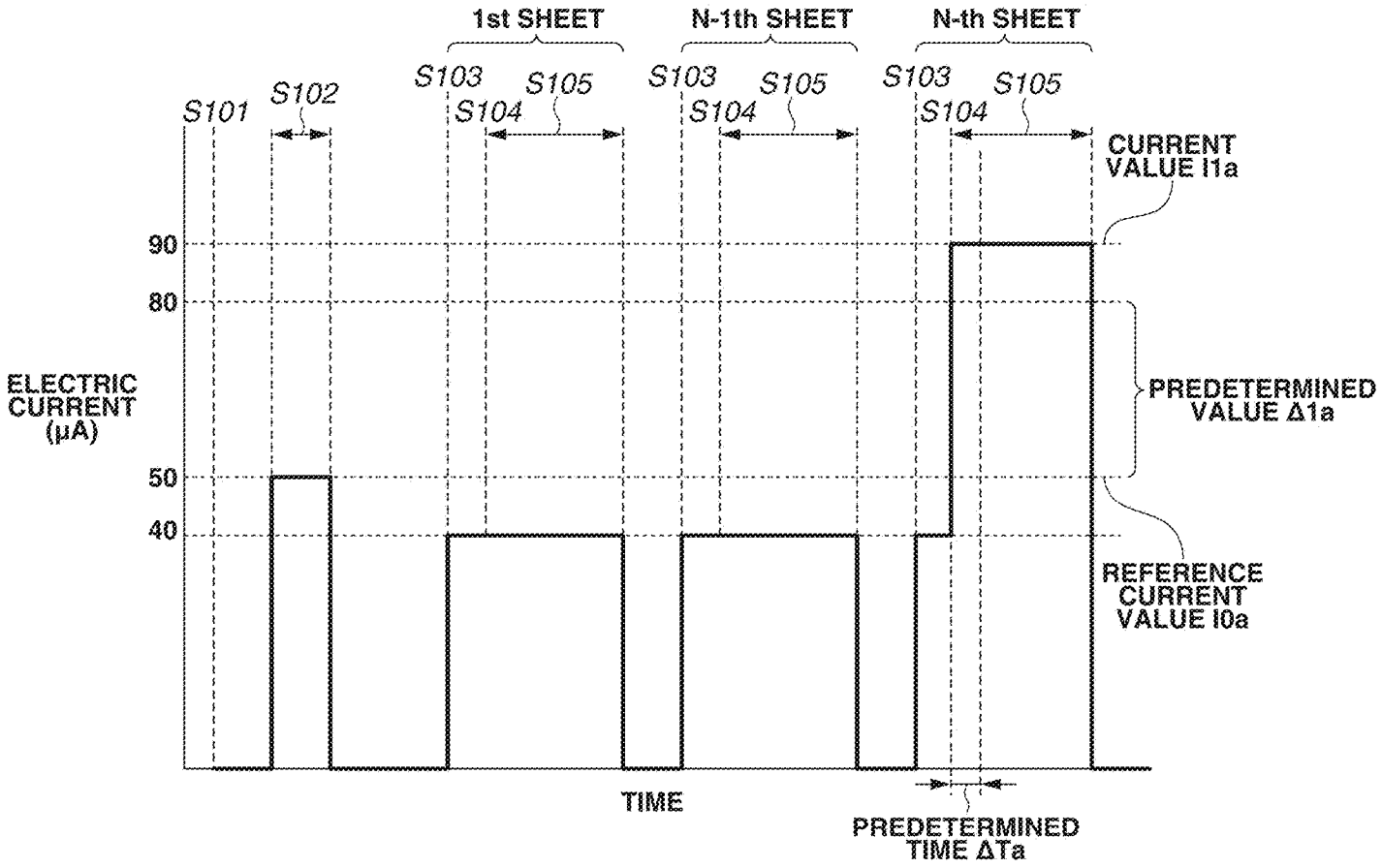
FIG. 5 is a graph illustrating a relationship between electric currents detected by a detection circuit and water droplets adhered to the fixing unit according to the first embodiment.

FIG. 5 is a graph illustrating a relationship between electric currents detected by the detection circuit 25 and water droplets adhered to the fixing unit 14 in the present embodiment. In the present embodiment, description will be given to the case where adhesion of the water droplets to the fixing unit 14 is determined when the n-th transfer material P (n≥3) passes through the fixing unit 14 while transfer materials P are being fed consecutively.

As illustrated in FIG. 5, after the image forming operation starts in step S101, the reference current value I0*a* is detected in step S102. The reference current value I0*a* in the present embodiment is detected as 50 μA. Herein, the predetermined value ΔIa and the predetermined time ΔTa are set as 30 μA and 0.3 sec., respectively, so that the control unit 110 determines that water droplets are adhered to the fixing unit 14 in a case where the current value Ila detected in step S105 is 80 μA or more and that value is continued for 0.3 sec. or more.

In the present embodiment, the current value I1*a* of the first transfer material P detected in step S105 is 40 μA, and a value thereof has not reached 80 μA. Accordingly, the control unit 110 determines that water droplets are not adhered to the fixing unit 14 when the first transfer material P passes through the fixing unit 14, and starts the image forming operation of the subsequent transfer material P. In addition, when the water droplets are not adhered to the fixing unit 14, the transfer current Itr is less likely to flow due to electrical resistance of the transfer material P, so that the current value I1*a* is less thanthe reference current value I0*a*.

Thereafter, a detection operation similar to that of the first transfer material P is executed with respect to the subsequent transfer materials P. In the present embodiment, no adhesion of water droplets to the fixing unit 14 is determined when the n−1th transfer material P passes through the fixing unit 14, so that the image forming operation of the n-th sheet starts continuously. Herein, as illustrated in FIG. 5, a current value I1*a* of the n-th transfer material P is detected as 90 μA, and the detection circuit 25 detects that the value equal to or greater than 80 μA is continued for 0.3 sec. or more. Therefore, the control unit 110 determines that water droplets are adhered to the fixing unit 14 and executes the dehumidification control of the fixing unit 14 for 30 sec. In the dehumidification control, the heating unit 31 of the fixing unit 14 and the pressure roller 30 are rotated while the heating unit 31 is being heated. Then, the image forming apparatus 100 notifies the user that image forming operation can restart, and the image forming operation restarts when the user confirms the notification.

In the present embodiment, description has been given to the case where water droplets are adhered to the fixing unit 14 when the n-th transfer material P (n≥3) passes through the fixing unit 14 while transfer materials P are being fed consecutively. However, the embodiment is not limited to the above, and presence or absence of water droplets can be determined through the method described in the present embodiment in a case where the water droplets are adhered to the fixing unit 14 when the first or the second transfer material P passes through the fixing unit 14.

In the present embodiment, as the dehumidification control for eliminating water droplets from the fixing unit 14, the heating unit 31 of the fixing unit 14 and the pressure roller 30 are rotated while the heating unit 31 is being heated. However, the embodiment is not limited thereto. As the dehumidification control for eliminating water droplets from the fixing unit 14, water droplets can be eliminated by increasing an interval between the transfer materials P passing through the fixing unit 14.

For example, when adhesion of water droplets to the fixing unit 14 caused by dew condensation is determined, an interval before the subsequent transfer material P passes through the fixing unit 14 may be increased. With this configuration, a time for waiting the water droplets adhered to the fixing unit 14 to evaporate can be provided, so that the fixing unit 14 can be dehumidified. Further, in a case where a plurality of subsequent transfer materials P exists, conveyance intervals between respective transfer materials P may be increased. With this configuration, the dehumidification control of the fixing unit 14 can be executed by gradually evaporating the water droplets when the transfer material P does not pass through the fixing unit 14. In addition, at this time, even if the heating unit 31 is not being heated, evaporation of water droplets canbe prompted by residual heat if the fixing unit 14 is still warm.

As described above, according to the present embodiment, by comparing the reference current value I0*a* before the transfer material P reaches the fixing unit 14 and the current value I1*a* when the transfer material P passes through the fixing unit 14, it is possible to determine presence or absence of water droplets adhered to the fixing unit 14. Further, when adhesion of water droplets to the fixing unit 14 is determined, water droplets can be eliminated through the dehumidification control executed by the control unit 110. With this configuration, it is possible to reduce occurrence of image defect caused by shortage of the transfer current Itr for transferring the toner image to the transfer material P from the intermediate transfer belt 7 at the secondary transfer portion.

In the present embodiment, in steps S102 and S105, the voltage V0 of a same value is applied to the secondary transfer roller 13 from the transfer power source 26, and presence or absence of water droplets adhered to the fixing unit 14 is determined based on the comparison between the reference current value I0*a* and the current value I1*a* detected by the detection circuit 25. However, the embodiment is not limited to the above, and presence or absence of water droplets adhered to the fixing unit 14 may be determined through constant current control in which the voltage applied to the secondary transfer roller 13 from the transfer power source 26 is detected by the detection circuit 25 serving as a detection unit. When water droplets are adhered to the fixing unit 14 to cause the electric current Ipr to flow to the ground, electric resistance thereof is lowered in comparison to the case where the electric current Ipr does not flow to the ground, and thus a value of the voltage applied to the secondary transfer roller 13 from the transfer power source 26 is lowered.

In other words, first, in step S102, voltage is applied from the transfer power source 26 so as to make a value of an electric current I0' flowing in the secondary transfer roller 13 be the same, and a reference applied voltage V0a' (first voltage) of the transfer power source 26 in step S102 is detected by the detection circuit 25. Then, in step S105, voltage is applied from the transfer power source 26 to make a value of the electric current I0' flowing in the secondary transfer roller 13 be the same, and an applied voltage V1*a*' (second voltage) of the transfer power source 26 in step S105 is acquired. Thereafter, if a state where the applied voltage V1*a*' in step S105 is lower than the reference applied voltage V0*a*' in step S102 by a preset predetermined value ΔVa or more is continued for a predetermined time ΔTa', the control unit 110 determines that water droplets are adhered to the fixing unit 14. At this time, similar to the present embodiment, the predetermined value ΔVa. and the predetermined time ΔTa' have to be set as appropriate according to the specification of the image forming apparatus 100.

Figure 6:
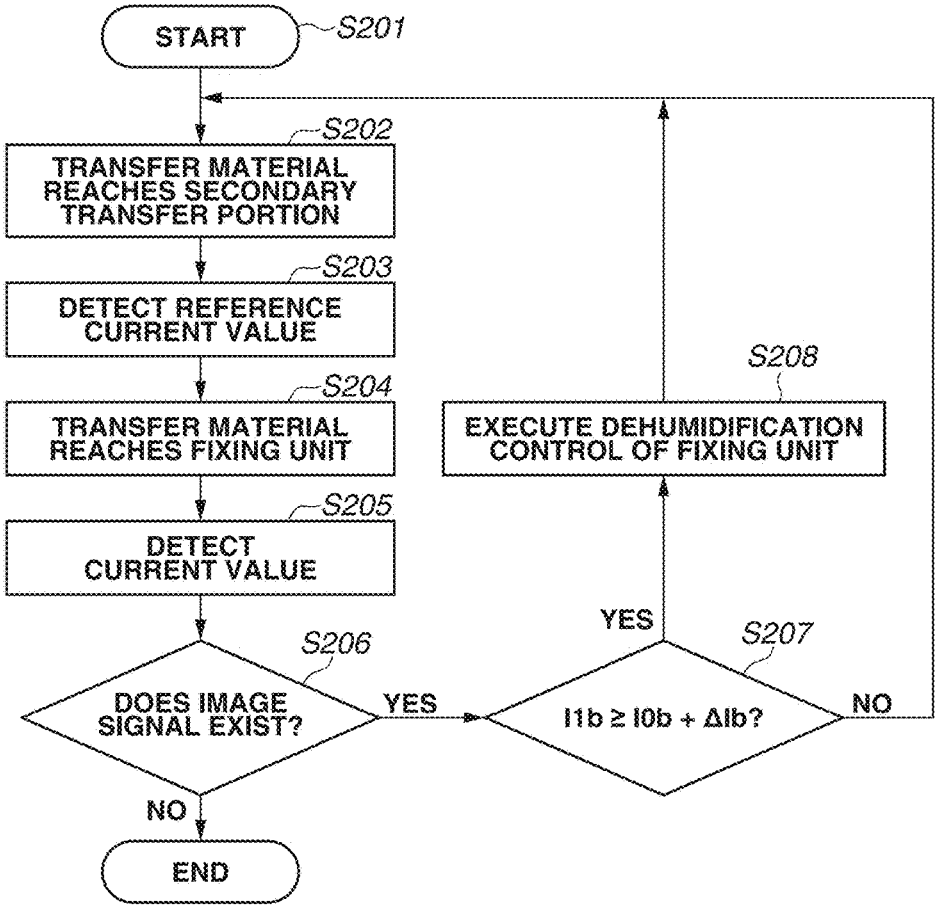
FIG. 6 is a flowchart illustrating dehumidification control according to a second embodiment.
Figure 7:
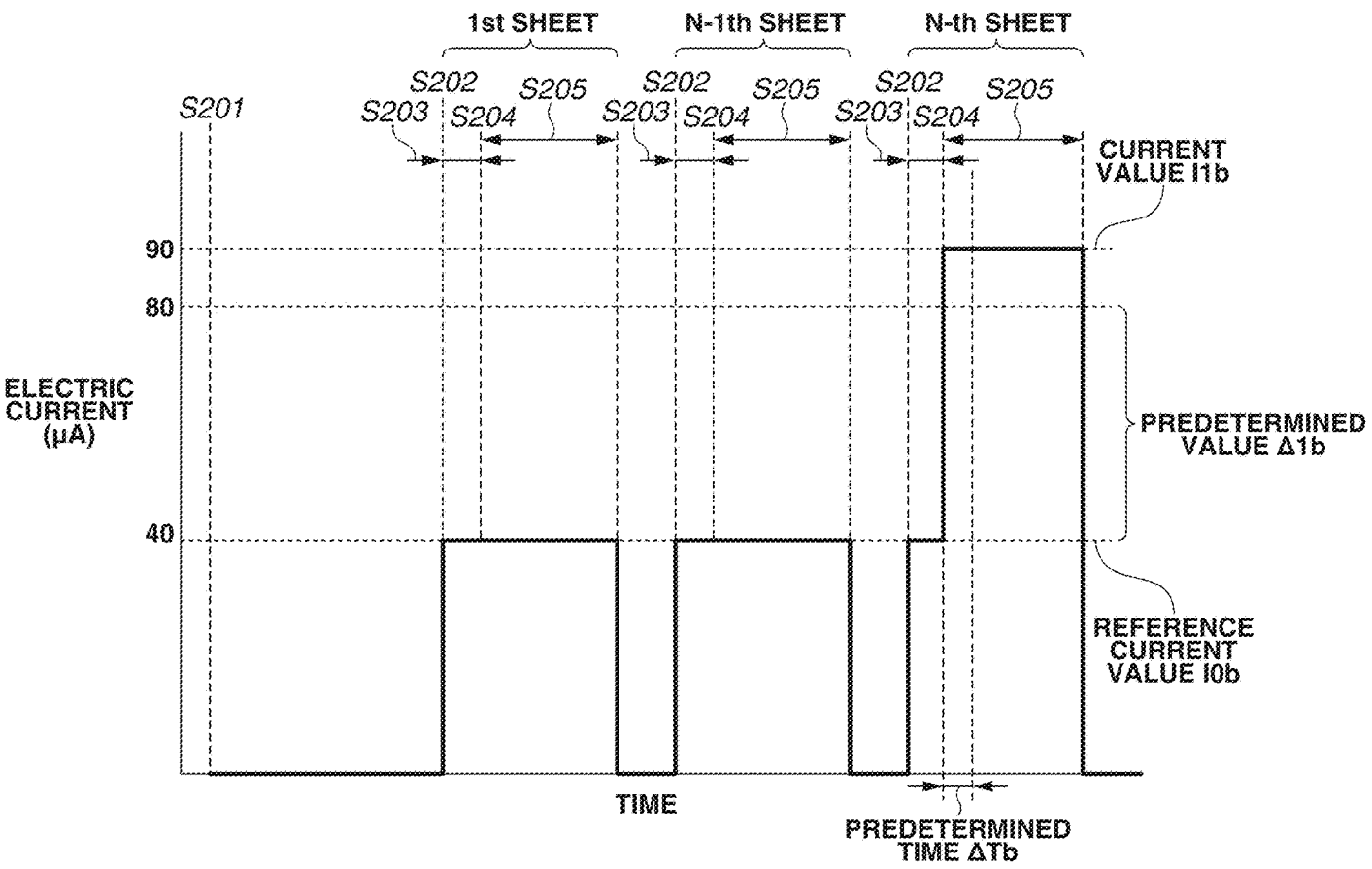
FIG. 7 is a graph illustrating a relationship between electric currents detected by a detection circuit and water droplets adhered to the fixing unit according to the second embodiment.

In the first embodiment, in step S102, before the transfer material P reaches the secondary transfer portion, the predetermined voltage V0 is applied to the secondary transfer roller 13 from the transfer power source 26, and the reference current value I0*a* flowing in the secondary transfer roller 13 is detected by the detection circuit 25. On the other hand, as illustrated in FIGS. 6 and 7, in a second embodiment, a configuration in which a reference current value I0*b* is detected after the transfer material P reaches the secondary transfer portion in step S203 will be described. A configuration described in the present embodiment is similar to that of the first embodiment except for a point in which the reference current value I0*b* is detected after the transfer material P reaches the secondary transfer portion in step S203, so that the same reference numerals are applied to the units common to those described in the first embodiment, and description thereof will be omitted.

<Detection of Water Droplets Adhered to Fixing Unit>

Hereinafter, with reference to FIGS. 6 and 7, a method of reducing the image defect by determining the presence or absence of water droplets caused by dew condensation adhered to the fixing unit 14 in the present embodiment will be described.

FIG. 6 is a flowchart illustrating dehumidification control of the present embodiment. As illustrated in FIG. 6, first, in step S201, the image forming operation starts by the image forming apparatus 100, and in step S202, the transfer material P reaches the secondary transfer portion. Then, in step S203, before the transfer material P that has reached the secondary transfer portion reaches the fixing portion N, a predetermined voltage V0 is applied to the secondary transfer roller 13 from the transfer power source 26, and a reference current value I0*b* (a first current value) is detected by the detection circuit 25. Herein, a value of the voltage V0 is 700 V while a period for applying the voltage V0 is 1 sec., and the reference current value I0*b* is an average value of current values detected in that period.

In step S204, the transfer material P reaches the fixing portion N of the fixing unit 14. Then, similar to the first embodiment, when the transfer material P is concurrently passing through the secondary transfer portion and the fixing unit 14 after reaching the fixing portion N, in step S205, the current value I1*b* (a second current value) flowing in the detection circuit 25 is detected. A secondary transfer operation is executed until the processing in steps S202 to S205 is completed, so that the voltage V0 is continuously applied to the secondary transfer roller 13 from the transfer power source 26. In the present embodiment, a distance between the secondary transfer portion and the fixing portion N is 50 mm, and a conveyance speed is 100 mm/sec., so that the reference current value In is detected within 0.5 sec. when the transfer material P passes through a region from the secondary transfer portion to the fixing portion N having a distance of 50 mm.

In step S206, in a case where it is determined that the image signal for forming an image on the subsequent transfer material P exists (YES in step S206), the processing proceeds to step S207. In step S207, the current value I1*b* and the reference current value I0*b* are compared to each other. If a state where the current value I1*b* is greater than the reference current value I0*b* by the preset predetermined value ΔIb or more is continued for the predetermined time ΔTb (YES in step S207), the control unit 110 determines that water droplets are adhered to the fixing unit 14 and executes processing in step S208. In a case where the current value I1*b* is not in the above-described state (NO in step S207), the processing returns to step S202. In step S208, as the dehumidification control executed by the control unit 110, an operation of rotating the heating unit 31 of the fixing unit 14 and the pressure roller 30 while heating the heating unit 31 is executed for 30 seconds. Thereafter, the image forming apparatus 100 notifies a user that image forming operation can restart. Then, after the user confirms the notification, the processing returns to step S202, and the image forming operation restarts. In the present embodiment, the predetermined value ΔIb and the predetermined time ΔTb are set as 40 μA and 0.3 sec., respectively.

A method of determining presence or absence of water droplets adhered to the fixing unit 14 by applying a voltage to the secondary transfer roller 13 from the transfer power source 26 and by detecting the electric current flowing in the secondary transfer roller 13 will be described with reference to FIG. 7. FIG. 7 is a graph illustrating a relationship between electric currents detected by the detection circuit 25 and water droplets adhered to the fixing unit 14 in the present embodiment. In the present embodiment, description will be given to the case where adhesion of the water droplets to the fixing unit 14 is determined when the n-th transfer material P (n≥3) passes through the fixing unit 14 while transfer materials P are being fed consecutively.

As illustrated in FIG. 7, both of the reference current values I0*b* in step S203 and the current values I1*b* in step S205 of the first to the n-1th transfer materials P are 40 μA. Herein, the predetermined value ΔIb and the predetermined time ΔTb are set as 40 μA and 0.3 sec., respectively, so that the control unit 110 determines that water droplets are adhered to the fixing unit 14 in a case where the current value I1*b* detected in step S205 is 80 μA or more and that value is continued for 0.3 sec. or more. Accordingly, the control unit 110 determines that water droplets are not adhered to the fixing unit 14 when the first to the n-1th transfer materials P pass through the fixing unit 14, so as to start image forming operation of the n-th. transfer material P continuously.

Herein, as illustrated in FIG. 7, a current value I1*b* of the n-th transfer material P is detected as 90 μA, and the detection circuit 25 detects that the value equal to or greater than 80 μA is continued for 0.3 sec. or more. Accordingly, the control unit 110 determines that water droplets are adhered to the fixing unit 14 and executes the dehumidification control of the fixing unit 14 for 30 seconds in step S208. Thereafter, the image forming apparatus 100 notifies the user that image forming operation can restart, and the image forming operation restarts when the user confirms the notification.

As described above, in the present embodiment, the reference current value I0*b* is detected by the detection circuit 25 before the transfer material P reaches the fixing portion N after reaching the second transfer portion. Then, presence or absence of water droplets adhered to the fixing unit 14 is determined by comparing the current value I1*b* and the reference current value I0*b* detected by the detection circuit 25 when the transfer material P concurrently passes through the secondary transfer portion and the fixing portion N after reaching the fixing unit 14. Because the dehumidification control of the fixing unit 14 is executed by the control unit 110 when adhesion of water droplets to the fixing unit 14 is determined thereby, an effect similar to the effect acquired in the first embodiment can be also acquired in the present embodiment.

Figure 8:
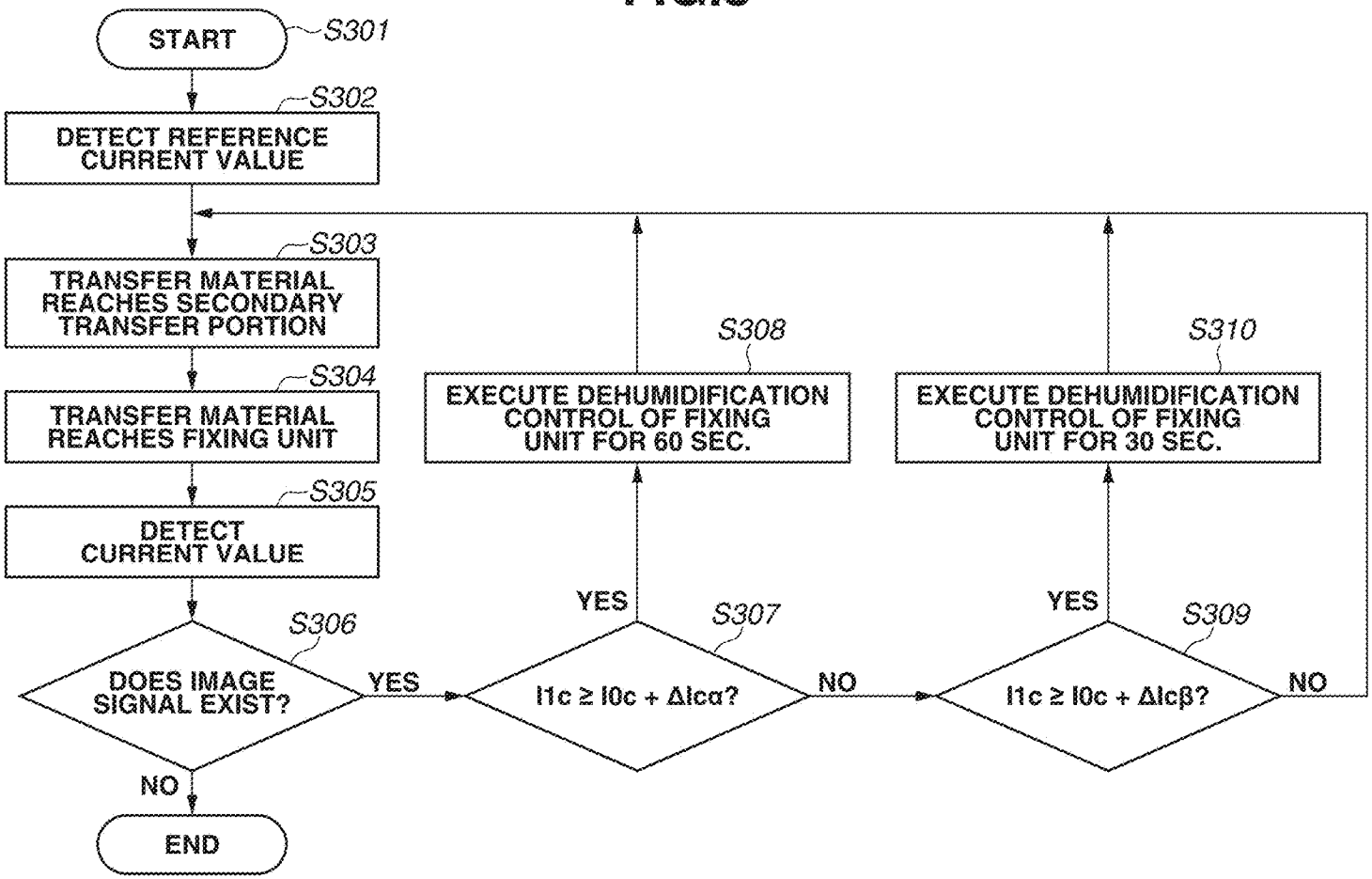
FIG. 8 is a flowchart illustrating dehumidification control according to a third embodiment.

In the first embodiment, if a state where the current value I1*a* is greater than the reference current value I0*a* by the predetermined value ΔIa or more is continued for the predetermined time ΔTa, adhesion of water droplets to the fixing unit 14 caused by dew condensation is determined, and the dehumidification control of the fixing unit 14 is executed by the control unit 110. On the other hand, as illustrated in FIG. 8, in a third embodiment, different dehumidification control is executed according to magnitude of a difference between the reference current value I0*c* and the current value I1*c* detected by the detection circuit 25. The present embodiment is similar to the first embodiment except for a point in which different dehumidification control is executed according to the magnitude of a difference between the reference current value I0*c* and the current value I1*c* detected by the detection circuit 25, so that reference numerals the same as those of the first embodiment are applied to the configuration common to those in the first embodiment, and description thereof will be omitted.

FIG. 8 is a flowchart illustrating dehumidification control of the present embodiment. Processing in steps S301 to S306 is similar to the processing in steps S101 to S106 in FIG. 3 of the first embodiment, so that description thereof will be omitted. In the present embodiment, a current value detected by the detection circuit 25 in step S302 is set as a reference current value I0*c* (a first current value), and a current value detected by the detection circuit 25 in step S305 is set as a current value I1*c* (a second current value).

As illustrated in FIG. 8, in the present embodiment, by comparing the reference current value I0*c* and the current value I1*c* in steps S307 and S309, a volume and presence or absence of water droplets adhered to the fixing unit 14 are determined. First, in step S307, the control unit 110 determines whether the volume of water droplets adhered to the fixing unit 14 is large. Specifically, if a state where the current value I1*c* is greater than the reference current value I1*c* by a preset predetermined value ΔIcα or more is continued for a predetermined time ΔTc (YES in step S307), the control unit 101 determines that a large volume of water droplets are adhered to the fixing unit 14 and executes processing in step S308. If the current value I1*c* is not in the above-described state (NO in step S307), the processing proceeds to step S309.

Next, in step S309, the control unit 110 determines presence or absence of water droplets adhered to the fixing unit 14. Specifically, if a state where the current value I1*c* is greater than the reference current value I0*c* by a preset predetermined value ΔIcβ or more is continued for the predetermined time ΔTc (YES in step S309), the control unit 101 determines that water droplets are adhered to the fixing unit 14 and executes processing in step S310. In a case where the current value I1*c* is not in the above-described state (NO in step S309), the processing returns to step S303.

Herein, the predetermined values ΔIcα (a first predetermined value) and ΔIcβ (a second predetermined value) respectively set in steps S307 and S309 are in a relationship of "ΔIcα>ΔIcβ". In the present embodiment, the predetermined values ΔIcα and ΔIcβ are set as 50 μA and 30 μA, respectively. When the volume of water droplets adhered to the fixing unit 14 is increased, a conduction path between the fixing frame 32 and the pressure roller 30 is increased, and thus the electric current Ip flowing to the ground from the secondary transfer portion is increased. In other words, because the current value I1*c* detected by the detection circuit 25 is also increased, it is possible to determine whether the volume of water droplets adhered to the fixing unit 14 is large by setting a plurality of different predetermined values when the current value I1*c* and the reference current value I0*c* are compared to each other.

In the present embodiment, as the dehumidification control executed by the control unit 110 in step S308, an operation of rotating the heating unit 31 of the fixing unit 14 and the pressure roller 30 while heating the heating unit 31 is executed for 60 seconds, in a case where the volume of water droplets adhered to the fixing unit 14 is large. On the other hand, as the dehumidification control executed by the control unit 110 in step S310, the operation of rotating the heating unit 31 of the fixing unit 14 and the pressure roller 30 while heating the heating unit 31 is executed for seconds, in a case where the volume of adhered water droplets is not so large although the water droplets are adhered to the fixing unit 14.

As described above, according to the present embodiment, in addition to acquiring the effect described in the first embodiment, the dehumidification control more appropriate for each state of water droplets adhered to the fixing unit 14 can be selected.

In the present embodiment, as the dehumidification control executed by the control unit 110, the heating unit of the fixing unit 14 and the pressure roller 30 are rotated while the heating unit 31 is being heated. Further, a period for executing the dehumidification control by the control unit 110 is changed according to the magnitude of a difference between the current value I1*c* and the reference current value I0*c* detected by the detection circuit 25. However, the configuration is not limited to the above. As the dehumidification control executed by the control unit 110, an interval between the transfer materials P passing through the fixing unit 14 may be increased, and the interval between the transfer materials P passing through the fixing unit 14 may be changed according to the magnitude of a difference between the current value I1*c* and the reference current value I0*c* detected by the detection circuit 25. Furthermore, as the dehumidification control executed by the control unit 110, either one or both of the operation of rotating the heating unit 31 of the fixing unit 14 and the pressure roller 30 while heating the heating unit 31 and the operation of changing the interval between the transfer materials P passing through the fixing unit 14 may be executed.

Although the embodiments relate to applied to a color image forming apparatus have been described as the above, the present invention is not limited to the above-described embodiments. Embodiments are applicable as long as the image forming apparatus includes a transfer member for transferring a toner image to a transfer material P from an intermediate transfer belt and a fixing unit. In other words, as illustrated in FIG. 9, an embodiment can be applied to a black-and-white image forming apparatus, and the same effect can be acquired.

An image forming unit of an image forming apparatus 400 of the present embodiment includes a photosensitive drum 401K as an image bearing member, a charging roller 402K as a charging unit, a development roller 403K as a development unit, and a cleaning blade 405K as a cleaning unit.

Figure 9:
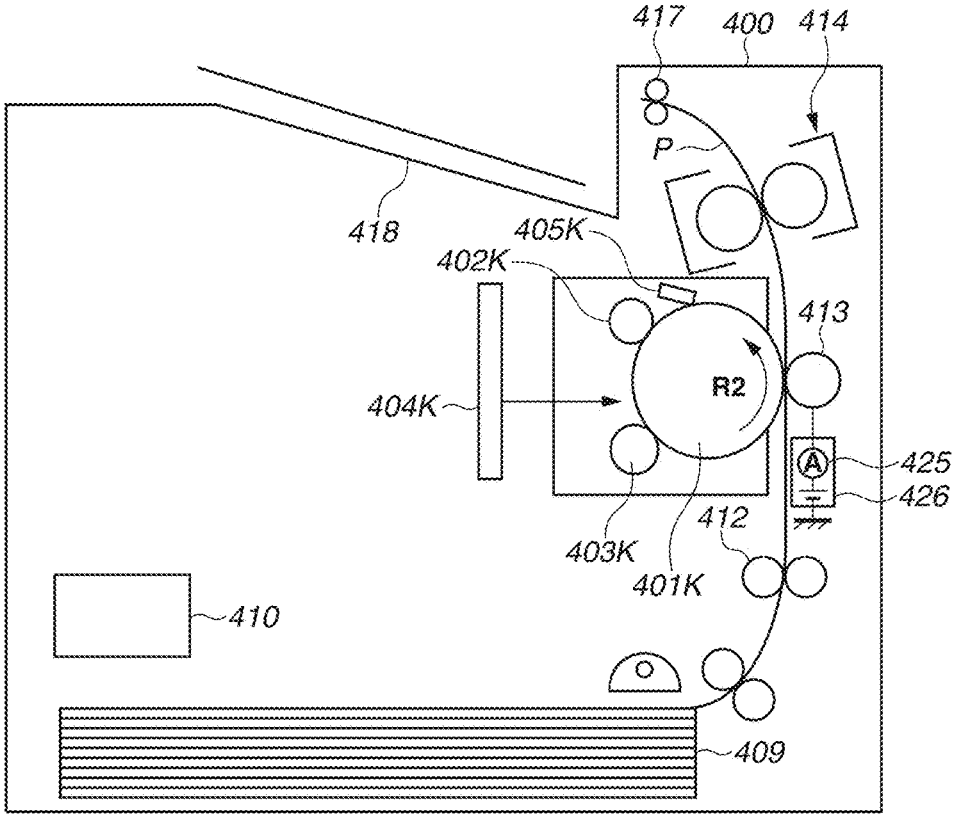
FIG. 9 a schematic cross-sectional diagram illustrating animage forming apparatus according to another embodiment.

Image forming operation starts when a control unit 410 receives an image signal, and the photosensitive drum 401K is rotationally driven in a direction indicated by an arrow R2 in FIG. 9 (i.e., counterclockwise direction). The photosensitive drum 401K is uniformly charged with a predetermined polarity (in the present embodiment, a negative polarity) and a predetermined potential by the charging roller 402K in the course of rotation, and exposed to light emitted from an exposure unit 404K according to an image signal. Through the above operation, anelectrostatic latent image corresponding to a target image is formed on the photosensitive drum 401K. After that, the electrostatic latent image is developed by the development roller 403K at a development position, so as to be visualized as a toner image on the photosensitive drum 401K. Herein, the normal charging polarity of the toner supplied to the photosensitive drum 401K from the development roller 403K is a negative polarity.

The photosensitive drum 401K as an image bearing member faces a transfer roller 413 as a transfer member to form a transfer portion. A transfer material P fed from a sheet feeding cassette 409 is conveyed to the transfer portion by a conveyance roller pair 412. Then, at the transfer portion, voltage is applied to the transfer roller 413 from a transfer power source 426 having a detection circuit 425 as a detection unit, so that the toner image is transferred to the transfer material P from the photosensitive drum 401K. Thereafter, a fixing unit 414 applies heat and pressure to the transfer material P to fix the toner image thereto, and the transfer material P is discharged to a discharge tray 418 by a discharge roller pair 417.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-132601, filed Jul. 4, 2016, which is hereby incorporated by reference herein in its entirety.

What is claimed is:

1. An image forming apparatus comprising:

an image bearing member configured to bear a toner image;

a transfer member abutting on the image bearing member and configured to transfer a toner image to a transfer material from the image bearing member;

a power source configured to apply voltage to the transfer member;

a detection unit configured to detect electric current flowing in the transfer member when voltage is applied to the transfer member from the power source;

a fixing unit configured to fix a toner image to a transfer material by heating the transfer material to which a toner image has been transferred by a heating unit; and a control unit configured to control the heating unit to heat the fixing unit, wherein the control unit controls the heating unit to heat the fixing unit in a state where conveyance of a subsequent transfer material stops after the transfer material that is in contact with the fixing unit is discharged from the fixing unit, in a case where a second current value that is detected by the detection unit when voltage is applied to the transfer member from the power source in a state where a transfer material is in contact with the fixing unit and the transfer member is greater than a first current value that is detected by the detection unit when voltage is applied to the transfer member from the power source before the transfer material reaches the fixing unit by a predetermined value or more.

2. The image forming apparatus according to claim 1, wherein the first current value is detected by the detection unit before a transfer material reaches a position where the transfer member abuts on the image bearing member.

3. The image forming apparatus according to claim 1, wherein the first current value is detected by the detection unit before a transfer material reaches the fixing unit after reaching a position where the transfer member abuts on the image bearing member.

4. The image forming apparatus according to claim. 1, wherein a predetermined voltage is applied to the transfer member from the power source while the first and the second current values are detected by the detection unit.

5. The image forming apparatus according to claim 1, wherein the control unit controls the heating unit to heat the fixing, unit in a state where conveyance of a subsequent transfer material stops after a transfer material that is in contact with the fixing unit is discharged from the fixing unit only in a case where a state where the second current value is greater than the first current value by the predetermined value or more is continued for a predetermined period of time.

6. The image forming apparatus according to claim 1, wherein the fixing unit includes the heating unit configured to heat a transfer material to which a toner image has been transferred and a pressurizing unit that faces the heating unit via the transfer material, and wherein a distance between a position where the transfer material is in contact with the transfer member when a toner image is transferred to the transfer material from the image bearing member and a position where the pressurizing unit abuts on the heating unit in a conveyance direction of the transfer material is shorter thana length of the transfer material on which an image can be formed.

7. The image forming apparatus according to claim 1, further comprising a photosensitive member, wherein the image bearing member is an endless intermediate transfer belt that bears a toner image transferred from the photosensitive member.

8. The image forming apparatus according to claim 1, further comprising a development unit configured to supply a toner image to the image bearing member, wherein the image bearing member is a photosensitive member on which an electrostatic latent image is developed by the development unit.

9. An image forming apparatus comprising:

an image bearing member configured to bear a toner image;

a transfer member abutting on the image bearing member and configured to transfer a toner image to a transfer material from the image bearing member;

a power source configured to apply voltage to the transfer member;

a detection unit configured to detect electric current flowing in the transfer member when voltage is applied to the transfer member from the power source;

a fixing unit configured to fix a toner image to a transfer material by heating the transfer material to which a toner image has been transferred; and a control unit configured to execute dehumidification control for dehumidifying the fixing unit, wherein the control unit executes the dehumidification control, in a case where a second current value that is detected by the detection unit when voltage is applied to the transfer member from the power source in a state where a transfer material is in contact with the fixing unit and the transfer member is greater than a first current value that is detected by the detection unit when voltage is applied to the transfer member from the power source before the transfer material reaches a position where the transfer member abuts on the image bearing member by a predetermined value or more.

10. The image forming apparatus according to claim 9, wherein a predetermined voltage is applied to the transfer member from the power source while the first and the second current values are being detected by the detection unit.

11. The image forming apparatus according to claim 9, wherein the control unit executes the dehumidification control only in a case where a state where the second current value is greater than the first current value by the predetermined value or more is continued for a predetermined period of time.

12. The image forming apparatus according to claim 9, wherein the fixing unit includes a heating unit configured to heat a transfer material to which a toner image has been transferred, and wherein the fixing, unit is heated by the heating unit in the dehumidification control in a state where conveyance of a subsequent transfer material stops after the transfer material that is in contact with the fixing unit is discharged from the fixing unit.

13. The image forming apparatus according to claim 9, wherein an interval between transfer materials passing through the fixing unit is increased by the dehumidification control.

14. The image forming apparatus according to claim 9, wherein the control unit executes first dehumidification control in a case where the second current value is greater than the first current value by a first predetermined value or more, and executes second dehumidification control in a case where the second current value is not greater than the first current value by the first predetermined value or more, but greater than the first current value by a second predetermined value or more, wherein the second predetermined value is less than the first predetermined value.

15. The image forming apparatus according to claim 14, wherein the fixing, unit includes a heating unit configured to heat a transfer material to which a toner image has been transferred, and wherein the fixing unit is heated by the heating unit in the first dehumidification control and the second dehumidification control, and a time period in which the heating unit heats the fixing unit in the first dehumidification control is longer than a time period in which the heating unit heats the fixing unit in the second dehumidification control.

16. The image forming apparatus according to claim 14, wherein an interval between transfer materials passing through the fixing unit is increased by the first dehumidification control and the second dehumidification control, and an interval between transfer materials passing through the fixing unit in the first dehumidification control is longer than an interval between transfer materials passing through the fixing unit in the second dehumidification control.

17. The image forming apparatus according to claim 9, wherein the fixing unit includes a heating unit configured to heat a transfer material to which a toner image has been transferred and a pressurizing unit that faces the heating unit via the transfer material, and wherein a distance between a position where the transfer material is in contact with the transfer member when a toner image is transferred to the transfer material from the image bearing member and a position where the pressurizing unit abuts on the heating unit in a conveyance direction of the transfer material is shorter than a length of the transfer material on which an image can be formed.

18. The image forming apparatus according to claim 9, further comprising a photosensitive member, wherein the image bearing member is an endless intermediate transfer belt that bears a toner image transferred from the photosensitive member.

19. The image forming apparatus according to claim 9, further comprising a development unit configured to supply a toner image to the image bearing member, wherein the image bearing member is a photosensitive member on which an electrostatic latent image is developed by the development unit.

20. An image forming apparatus comprising:

an image bearing member configured to bear a toner image;

a transfer member abutting on the image bearing member and configured to transfer a toner image to a transfer material from the image bearing member;

a power source configured to apply voltage to the transfer member;

a detection unit configured to detect voltage applied to the transfer member from the power source when electric current flows in the transfer member;

a fixing unit configured to fix a toner image to a transfer material by heating the transfer material to which a toner image has been transferred by a heating unit; and a control unit configured to control the heating unit to heat the fixing unit;

wherein, before a transfer material reaches the fixing unit, the detection unit detects a first voltage applied to the transfer member from the power source to cause a predetermined electric current to flow in the transfer member, and detects a second voltage applied to the transfer member from the power source to cause a predetermined electric current to flow in the transfer member in a state where a transfer material is in contact with the fixing unit and the transfer member, and wherein, in a case where the second voltage is lower than the first voltage by a predetermined value or more, the control unit controls the heating unit to heat the fixing unit in a state where conveyance of a subsequent transfer material stops after a transfer material that is in contact with the fixing unit is discharged from the fixing unit.

21. The image forming apparatus according to claim 20, wherein the first voltage is detected by the detection unit before a transfer material reaches a position where the transfer member abuts on the image bearing member.

22. The image forming apparatus according to claim 20, wherein the first voltage is detected by the detection unit before a transfer material reaches the fixing unit after reaching a position where the transfer member abuts on the image bearing member.

23. An image forming apparatus comprising:

an image bearing member configured to bear a toner image;

a transfer member abutting on the image bearing member and configured to transfer a toner image to a transfer material from the image bearing member;

a power source configured to apply voltage to the transfer member;

a detection unit configured to detect electric current flowing in the transfer member when voltage is applied to the transfer member from the power source;

a fixing unit configured to fix a toner image to a transfer material by heating the transfer material to which a toner image has been transferred by a heating unit; and a control unit configured to control the heating unit to heat the fixing unit, wherein the control unit controls the heating unit to heat the fixing unit after the transfer material that is in contact with the fixing unit is discharged from the fixing unit, in a case where a second current value that is detected by the detection unit when voltage is applied to the transfer member from the power source in a state where the transfer material is in contact with the fixing unit and the transfer member is greater than a first current value that is detected by the detection unit when voltage is applied to the transfer member from the power source before the transfer material reaches the fixing unit by a predetermined value or more.

24. The image forming apparatus according to claim 1, wherein the fixing unit includes the heating unit configured to heat a transfer material and a pressurizing unit that contacts the heating unit to form a fixing portion for holding the transfer material in an interposed manner between the heating unit and the pressurizing unit, wherein the control unit heats the fixing unit by rotating the heating unit and the pressurizing unit in a state where the heating unit is being heated.

25. The image forming apparatus according to claim 24, wherein the fixing unit includes a conductive frame that covers the heating unit and the pressurizing unit, and the conductive frame is electrically connected to the ground.

26. The image forming apparatus according to claim 25, wherein the conductive frame is arranged in proximity to the pressurizing unit and an insulating member is arranged between the conductive frame and the pressurizing unit.

27. The image forming apparatus according to claim 24, wherein the heating unit is arranged to face the transfer material held at the fixing portion in an interposed manner and the heating unit includes a heater configured to generate heat when alternating voltage is applied thereto and a tubular flexible member that covers the heater, and wherein the heater is arranged at position facing the pressurizing unit through the flexible member.

28. The image forming apparatus according to claim 9, wherein the fixing unit includes the heating unit configured to heat a transfer material and a pressurizing unit that contacts the heating unit to form a fixing portion for holding the transfer material in an interposed manner between the heating unit and the pressurizing unit, and wherein the control unit executes the dehumidification control by rotating the heating unit and the pressurizing unit in a state where the heating unit is being heated.

29. The image forming apparatus according to claim 28, wherein the fixing unit includes a conductive frame that covers the heating unit and the pressurizing unit, and the conductive frame is electrically connected to the ground.

30. The image forming apparatus according to claim 29, wherein the conductive frame is arranged in proximity to the pressurizing unit and an insulating member is arranged between the conductive frame and the pressurizing unit.

31. The image forming apparatus according to claim 28, wherein the heating unit is arranged to face the transfer material held at the fixing portion in an interposed manner and the heating unit includes a heater configured to generate heat when alternating voltage is applied thereto and a tubular flexible member that covers the heater, and wherein the heater is arranged at position facing the pressurizing unit through the flexible member.

* * * * *